US007390104B2

(12) United States Patent
Coushaine

(10) Patent No.: US 7,390,104 B2
(45) Date of Patent: Jun. 24, 2008

(54) PORTABLE LED LAMP

(75) Inventor: Charles M. Coushaine, Rindge, NH (US)

(73) Assignee: Osram Sylvania, Inc., Danvers, MA (US)

( * ) Notice: Subject to any disclaimer, the term of this patent is extended or adjusted under 35 U.S.C. 154(b) by 88 days.

(21) Appl. No.: 11/121,492

(22) Filed: May 3, 2005

(65) Prior Publication Data

US 2006/0250789 A1 Nov. 9, 2006

(51) Int. Cl.
*F21L 4/02* (2006.01)

(52) U.S. Cl. ..... 362/184; 362/187; 362/196; 362/203; 362/205; 362/240; 362/249; 362/251; 362/800

(58) Field of Classification Search ..... 362/251, 362/252, 249, 800, 184, 187, 196, 203, 205, 362/240

See application file for complete search history.

(56) References Cited

U.S. PATENT DOCUMENTS

| | | | | |
|---|---|---|---|---|
| D99,105 | S | 3/1936 | Arenberg | |
| D104,233 | S | 4/1937 | Arenberg | |
| D128,125 | S | 5/1941 | Rutledge | |
| D215,481 | S | 10/1969 | Dawson | |
| 4,204,272 | A * | 5/1980 | Kim | 362/200 |
| 4,734,834 | A | 3/1988 | Petzl et al. | |
| 5,193,895 | A * | 3/1993 | Naruke et al. | 362/542 |
| D341,441 | S | 11/1993 | Shapiro | |
| D341,442 | S | 11/1993 | Shapiro | |
| 5,408,764 | A * | 4/1995 | Wut | 36/137 |
| 5,469,345 | A * | 11/1995 | Pettersen et al. | 362/188 |
| 6,086,218 | A | 7/2000 | Robertson | |
| 6,106,137 | A * | 8/2000 | Adams et al. | 362/237 |
| D431,307 | S | 9/2000 | Zelina, Jr. et al. | |
| D443,713 | S | 6/2001 | Benensohn | |
| 6,288,498 | B1 | 9/2001 | Cheng | |
| D475,802 | S | 6/2003 | Homann | |
| D476,105 | S | 6/2003 | Alsobrook | |
| D482,486 | S | 11/2003 | Demers | |
| 6,641,283 | B1 | 11/2003 | Bohler | |
| D484,270 | S | 12/2003 | Yiu | |
| 6,752,515 | B2 | 6/2004 | Evans et al. | |
| D503,007 | S | 3/2005 | Duscha et al. | |
| 2005/0094395 | A1 | 5/2005 | Rosenberg | |
| 2005/0207158 | A1 * | 9/2005 | Nagai | 362/251 |
| 2006/0176703 | A1 | 8/2006 | Cayton et al. | |

FOREIGN PATENT DOCUMENTS

| | | |
|---|---|---|
| DE | 37 12 602 A1 | 4/1987 |
| DE | 195 44 807 C2 | 6/1997 |

OTHER PUBLICATIONS

Angus Noble, Indium Rechargeable Torch, https://www.angusnoble.com, 5 pages, date unknown.

(Continued)

*Primary Examiner*—Stephen F. Husar
*Assistant Examiner*—Meghan K. Dunwiddie
(74) *Attorney, Agent, or Firm*—Sterne, Kessler, Goldstein & Fox P.L.L.C.

(57) ABSTRACT

A snapped together portable lamp assembly may be formed with a deformable reflector. Cutouts in the reflector form a resiliently flexible web that enables axially flexing to initiate a spring operated electrical switch. A covering lens may transmit the initiating force to turn the lamp on or off. The structure is compact, easily operated with a single touch and inexpensive to make.

11 Claims, 7 Drawing Sheets

OTHER PUBLICATIONS

The Brinkmann Corporation, Go-LED, Portable White L.E.D. Mini-Lights © 2005, 2 pages, date unknown.

Buddy Light, 1 page, date unknown.

Garrity Industries, LED Touch 'N Lite located at http://www.garritypromo.com/ClientProductListing,asp?strSearch=category&category =New%20Lites&str__PageNo=0&strCriteria=New%20Lites, 3 pages, date unknown.

Garrity Industries, 3 LED Touch 'N Lite, located at http://www.garritypromo.com/ClientProductListing.asp?strSearch=category &category =New%20Lites&str__PageNo=0 &strCriteria=New%20Lites, 3 pages, date unknown.

Push Lite, The easy-to-use lights that work anywhere!, 2 pages, date unknown.

International Search Report and Written Opinion of the International Searching Authority for International application No. PCT/US06/08062, dated Feb. 9, 2007, 11 pages.

* cited by examiner

PORTABLE LED LAMP

BACKGROUND OF THE INVENTION

1. Field of the Invention

The invention relates to electric lamps and particularly to portable electric lamps. More particularly the invention is concerned with portable LED lamp assemblies.

2. Description of the Related Art including Information Disclosed Under 37 CFR 1.97 and 1.98

It is common for vehicles to have interior dome lamps to illuminate the vehicle interior. Sometimes the amount of light or the orientation of light is inappropriate for the use desired. For example the rear area may receive an insufficient amount of light, or the item to be illuminated may need to be illuminated close up for proper viewing. It can also be desirable to have an interior lamp on while at the same time not interfering with the driver's vision. It can be equally desirable to have a lamp that is detachable for use outside the vehicle, and at the same time one that is compact, easily turned on and variably attached in the vehicle interior. Ordinary flashlights are bulky, and can be difficult for a driver to operate while driving. Ordinary flashlights depend on batteries for long operating lives, but long operating life makes them bulky and less easy to position in a vehicle. Ordinary flashlights are also not generally attachable to a vehicle interior for fixed positioning if that is desired. There is then a need for a detachable vehicle interior lamp that is easily turned on, and has a long life.

BRIEF SUMMARY OF THE INVENTION

A portable LED lamp assembly may be made from a case including a base. The case encloses a power source; at lease one LED light source; and a spring driven electric switch. The light source is mechanically supported by the case to face axially toward a field to be illuminated. The switch is supported on the base, and oriented to be operated by forced contact at a switch contact between an on position and an off position by motion in the opposed axial direction. The power source, at least one LED light source and switch are electrically coupled together as a switched circuit. The lamp includes a reflector having a first contact point anchored to the case and a second contact point abutting the switch point. The reflector is resiliently deformable intermediate the first contact point and the second contact point. The reflector further includes a formed passage sized and positioned to admit the LED light source there in.

DETAILED DESCRIPTION OF THE INVENTION

Figure 1:
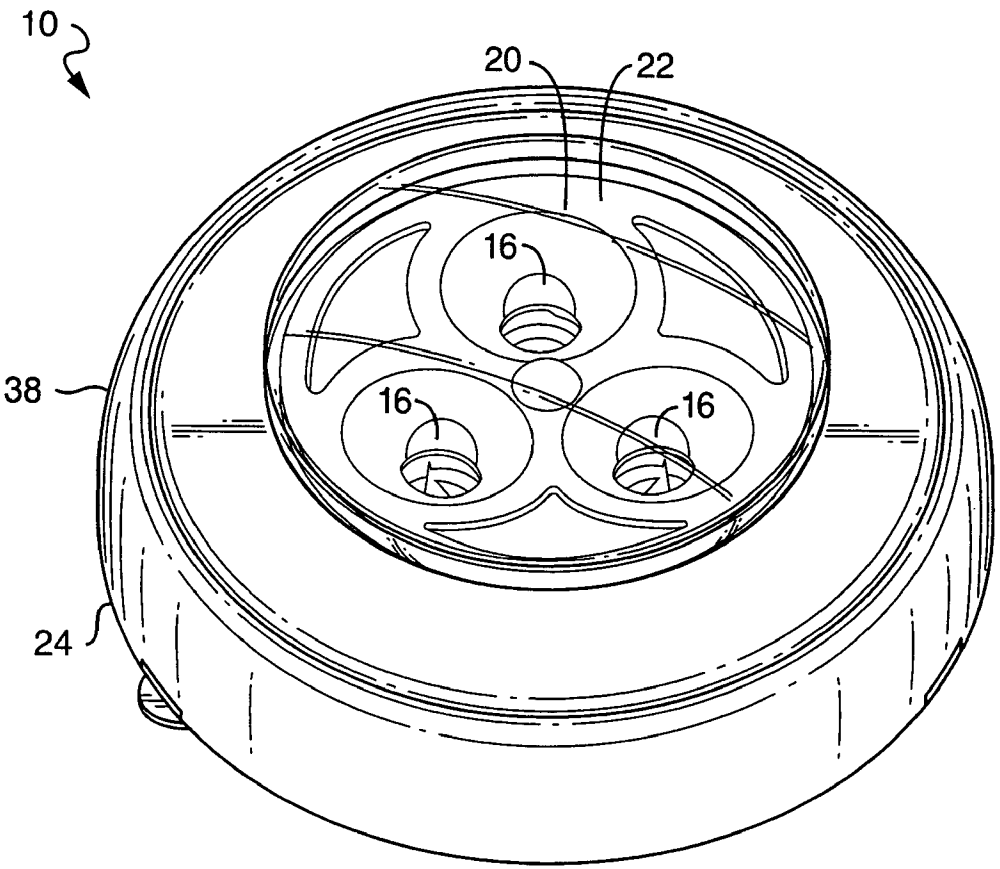
FIG. 1 shows a front perspective view of a portable LED lamp with a lens.

FIG. 1 shows a front perspective view of a portable lamp 10 looking through the cover lens. The portable lamp assembly

10 may be formed from a case, batteries 14, LED light sources 16, a switch 18, a reflector 20 and a cover lens 22.

The preferred case has the general form of a cylinder with a diameter greater than the axial height. The case may be conveniently formed from subsections such as a back plate 24 and a face ring 38.

Figure 2:
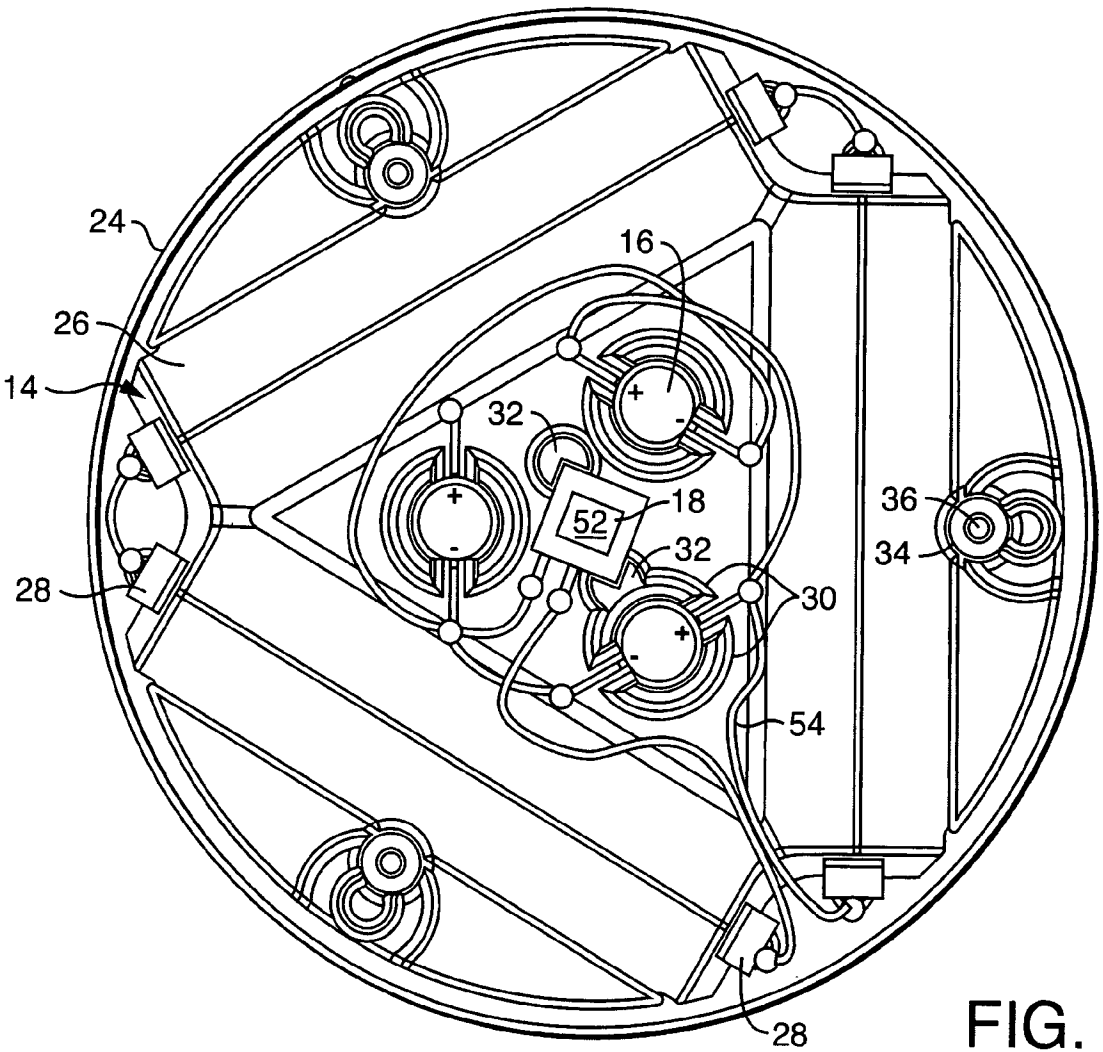
FIG. 2 shows a front perspective view of a back plate.

FIG. 2 shows a front perspective view of a back plate 24. The back plate 24 may be formed from stamped sheet metal, molded plastic or other material. The preferred back plate 24 is made from a non-conductive plastic with molded bosses and retainers to conveniently receive, hold and align the batteries 14, light sources 16, switch 18, reflector 20, and face ring 38. In the preferred embodiment there are three sets of battery brackets 26 including three pairs of corresponding conductive spring clips 28 to contact the battery terminals (one set is identified). The battery brackets 26 may be molded tubular recesses formed on the back side of the back plate 24 to cradle the correspondingly tubular batteries, and enable the batteries to be easily replaced through a rear access. The battery bracket 26 may be molded with open ends or slots to enable the conductive spring clips 28 to be positioned adjacent and to contact the battery end terminals. Similarly, the three LED light sources 16 (one is identified) are held in three sets of lamp brackets 30 (one set is identified). The switch 18 is held by a of pair posts defining a centrally located switch bracket 32. There are three peripherally located support posts 34 (one is identified) formed to couple with the periphery of the reflector 20. The preferred post 34 includes a ball or pin top 36 that may be snapped into a hole 56 formed in the reflector 20. The rear side of the back plate 24 (not shown) may be further formed with a variety of convenient attachment mechanisms as are know in the art, for example an exposable glue face, a Velcro face, a rocking pivot, a spring clip, a stiff loop to clip to a vehicle visor, a magnet or any other convenient structure adapted to be attached at convenient places in a vehicle. The preferred back attachment is a cover plate 100 with three holes for screwed attachment into the back plate 24. The cover plate 100 may be exteriorly faced with a double-sided adhesive tape 104, enabling the LED lamp to be stuck to any available surface.

Figure 3:
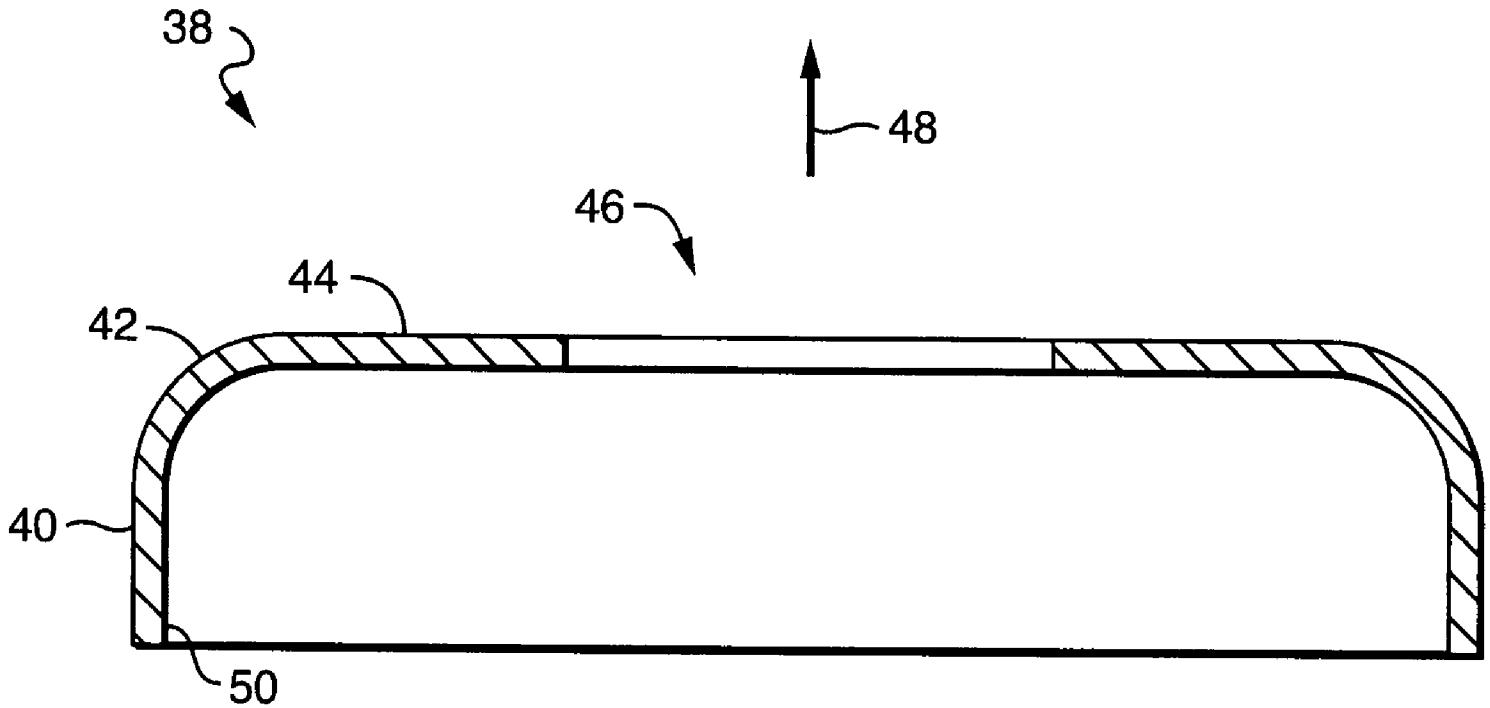
FIG. 3 shows a cross sectional view of a face ring.

FIG. 3 shows a cross sectional view of a face ring 38. The preferred face ring 38 is stamped from sheet metal or molded from plastic to have a cylindrical sidewall 40. The preferred cylindrical sidewall 40 has a rolled shoulder 42 that leads to a front side 44 formed with a central opening 46 that is preferably circular. The central opening 46 faces along an axis 48 to a field to be illuminated. The back plate 24 and the face ring 38 may be formed with a compressible fitting 50 to be snap together as a user openable coupling, if necessary.

The back plate 24 and face ring 38 assembly, define an enclosed volume and a circular opening 46 leading to the enclosed volume. Enclosed in the volume is a battery power source; for example three triple A batteries held adjacent the back plate 24 by formed battery brackets 26, and spring clips 28. The spring clips 28 are coupled by wires as part of the operating circuit 54.

One or more LED light sources 16 are mounted in lamp brackets 30 formed on the back plate 24. The LED light sources 16 are mechanically supported by the back plate 24 to face axially through the circular face ring opening 46 toward the field to be illuminated. In the preferred embodiment three LED light sources 16 are located equilaterally around the axis 48. The LED light sources 16 may be electrically coupled by wires in the circuit with the batteries 14 and switch 18 to form circuit 54.

The switch 18 is located in the switch bracket 32 preferably located centrally to face the circular face ring opening 46. The spring tension operated electric switch 18 is mounted on one side to the back plate 24, while an opposite side of the switch 18 provides a switch contact 52 that faces axially forward, and is within the axially projected area of the face ring opening 46, and preferably in the center of the axially projected area of the face ring opening 46. The switch 18 is then operated axially between an on position and an off position by forced contact at the switch contact 52 in the opposed axial direction. The battery power source 14, the LED light sources 16 and the switch 18 are electrically coupled together as a switched circuit 54. Additional circuitry features may be included as are known in the art of portable light sources, such as high and low illumination levels, signaling, flashing, alternative colors, and so on.

Figure 4:
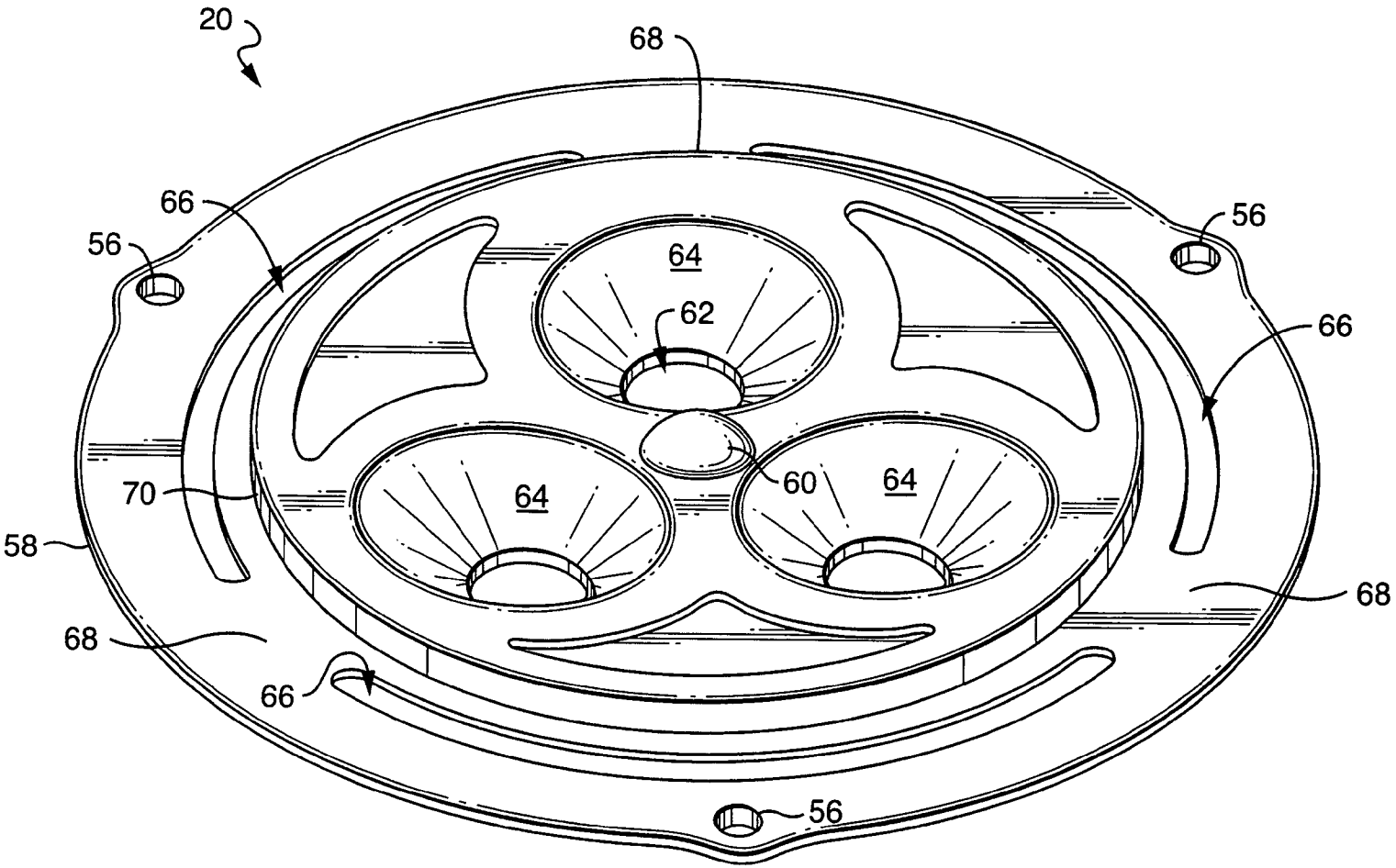
FIG. 4 shows a front perspective view of a reflector.

FIG. 4 shows a front perspective view of a reflector 20. The reflector 20 is formed from a resiliently flexible sheet material, and is sized and shaped to span at least the circular opening 46. The preferred reflector 20 has a plurality of coupling points 56 formed on a periphery ring 58 of the reflector 20 that are coupled to the back plate 24. The preferred mounting is formed between the extended support posts 34 with the respective coupling ball or pin tops 36 that then snap fit in holes forming coupling points 56 formed in the peripheral ring 58. The reflector 20 is then removably attached to the back plate 24 along the periphery ring 58. The reflector 20 also includes a reflector contact 60 located to abut directly or indirectly the front switch contact 52. For example, when the switch contact 52 is centrally positioned, the reflector contact 60 may also be centrally located. The reflector 20 includes for each of the respective LED light sources 16 a corresponding through passage 62 to admit passage of at least the light emitting portion of the respective LED 16, which may be the emitting end of a light guide or lens forming a portion of an LED module. Similarly, the reflector 20 is preferably formed with wall portions adjacent the respective through passage 62 providing a respective optically reflective surface 64 positioned to receive light emitted from the LED light source 16 positioned in the respective through passage 62 and reflect that light to the field to be illuminated. The electrical connections, heat sinking and other non-light emitting portions of the LED need not be exposed to the reflective surface 64 or in the defined passage 62, but may remain on the back side of the reflector 20. The reflector 20 further includes a plurality of cutouts 66 positioned radially intermediate the coupling points 56 and the reflector contact 60. In the preferred embodiment three cutouts 66 extend along a common circle leaving only three small resiliently flexible bridges 68 connecting the peripheral ring 58 and the central region with the reflector contact 60, the through passages 62 and the reflector surfaces 64. This forms a resilient and flexible web whereby the reflector 20 may be axially and resiliently deformed intermediate the coupling points 56 and the reflector contact 60. The reflector 20 may then be axially deformed repeatedly to axially press against the switch contact 52 and activate switch 18 transitions between the off position and the on position. The preferred reflector 20 further includes a lens coupling 70; for example a circular wall or a circular crevice formed radially interior to the cutouts 66 so the rigid lens 22 does not inhibit the axial deformation of the reflector 20.

Figure 5:
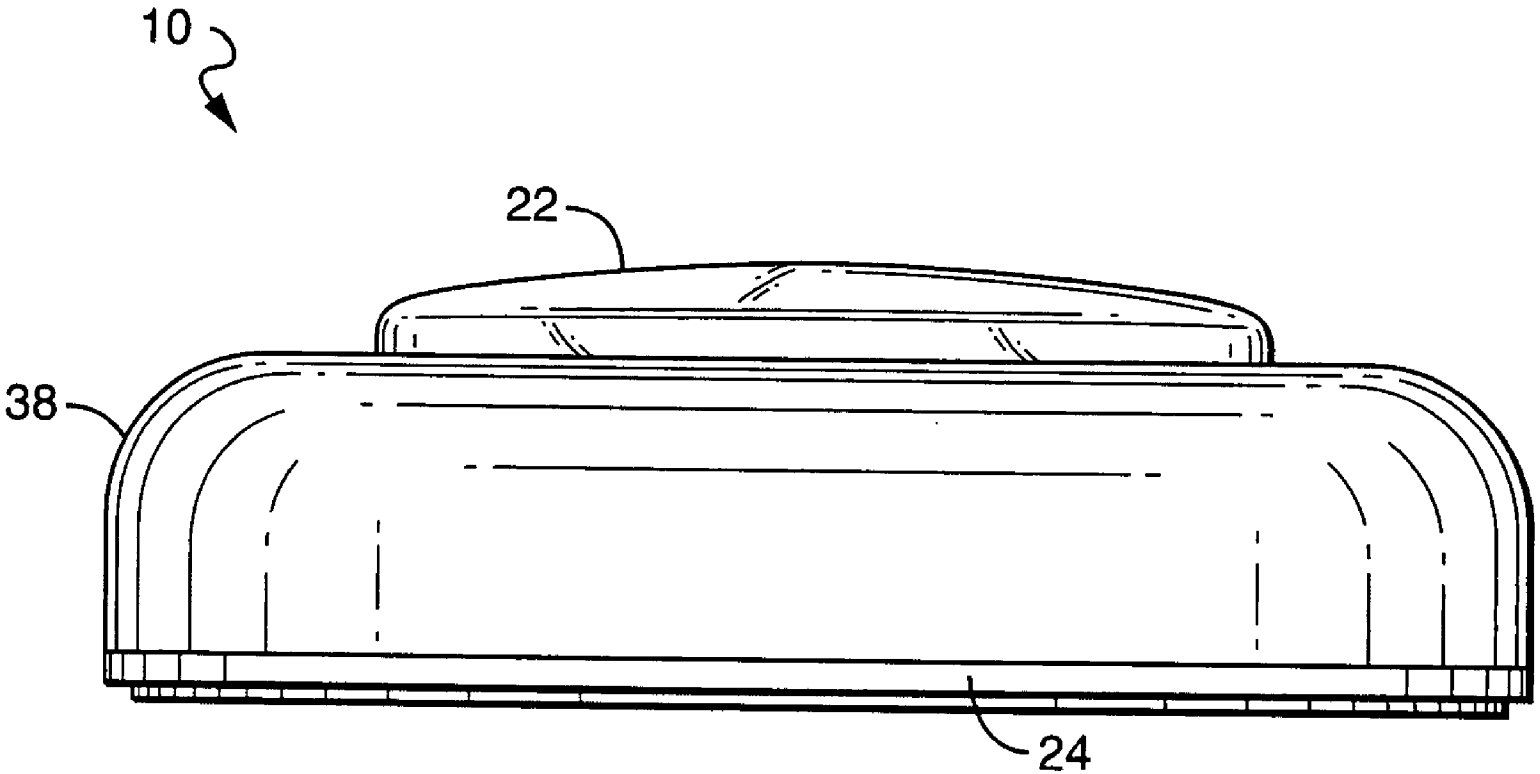
FIG. 5 shows a side view of a portable lamp.

FIG. 5 shows a side view of a portable lamp 10 with the lens 22 in place. Coupled to the reflector 20 is preferably a light transmissive lens 22. The lens 22 spans axial projection of the least the LED light sources 16 and the respective reflective surfaces 64. For example a circular lens 22 with a peripheral edge may be circumferentially snap mounted against a corresponding circular wall or into a circular crevice (lens coupling 70) formed on the reflector 20.

Figure 6:
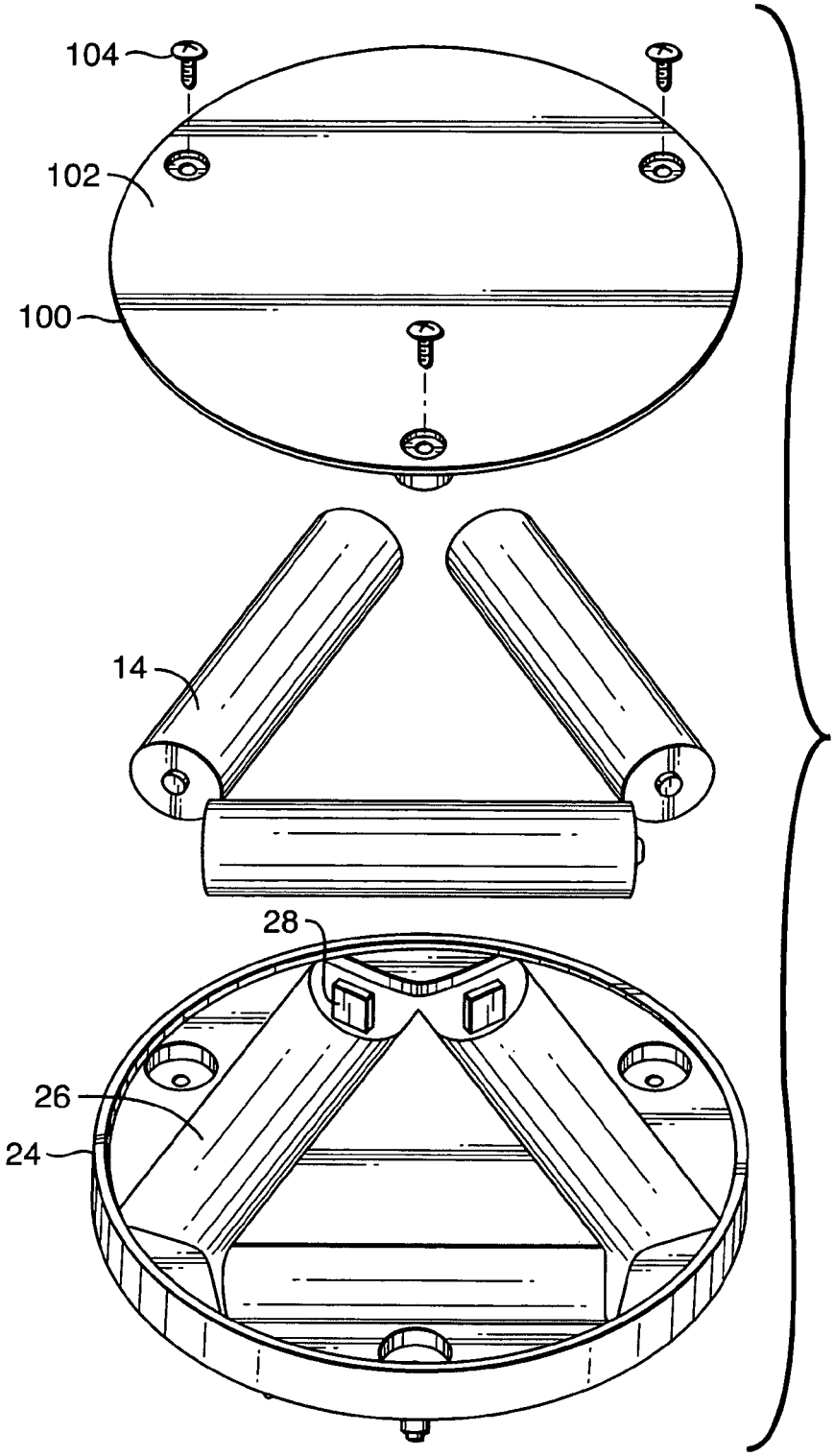
FIG. 6 shows an exploded view of the back plate, batteries, cover plate and screws.

FIG. 6 shows an exploded view of the back plate 24, and batteries 14 enclosed by a cover plate 100. Positioned on the back of the cover plate 100 is double sided adhesive tape 102 that enables the LED lamp to be mounted on any convenient surface. The back plate 24 may be coupled to the cover plate 100 by three screws 104.

Figure 7:
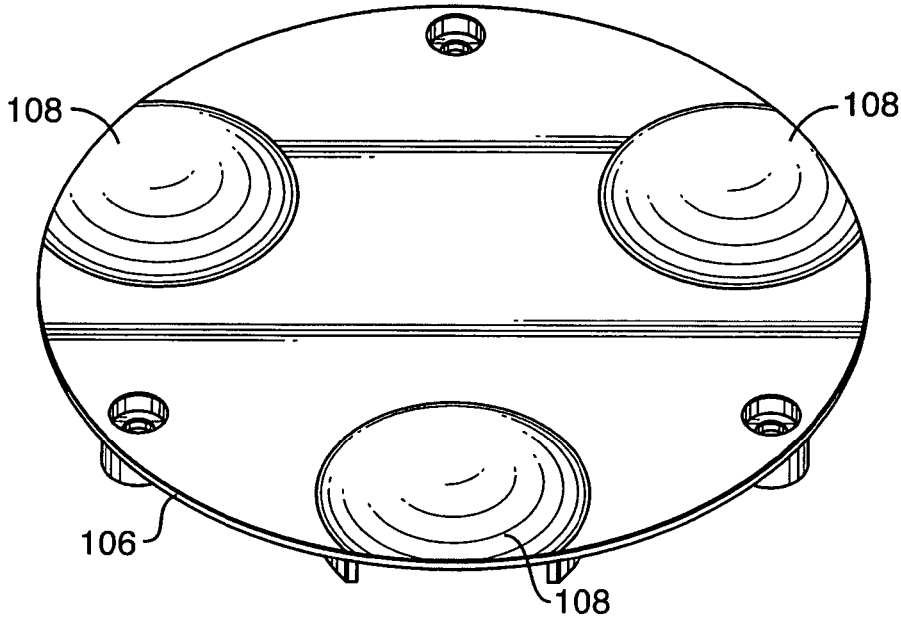
FIG. 7 shows an alternative back plate.

FIG. 7 shows an alternative back plate 106. The alternative back plate 106 is formed with three projecting mounds 108 each of which is positioned adjacent an outer edge of the back plate, and equally angularly around the outer edge of the back plate 106. The mounds 108 stand up from the surrounding area of the backside of the case. The preferred mounds 108 are spherical sections with circular perimeters along the surrounding flat surface of the back plate. The mounds 108 have diameters of about one third the diameter of the backplate, and have center heights from the surrounding flat surface of about 0.25 millimeters. The mounds in one instance enable the portable lamp to be rocked back and forth with respect to a flat mounting surface, thereby freeing it from its position. In a second instance the mounds 108 allow the lamp to be nestled against projections and crevices with respect in an irregular mounting surface.

Figure 8:
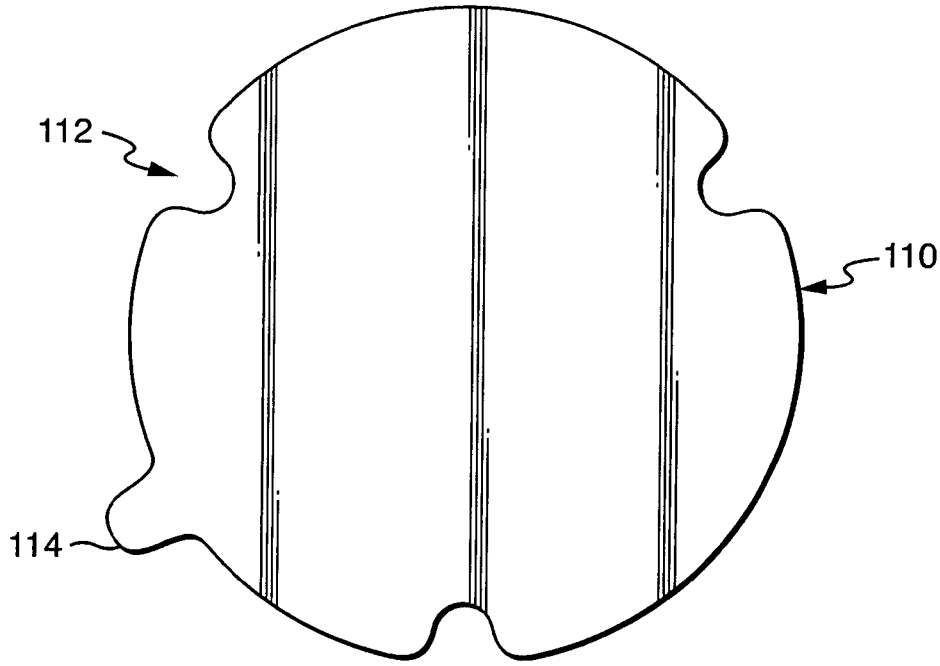
FIG. 8 shows a doubled sided adhesive mounting tape.

FIG. 8 shows an alternative double-sided adhesive tape 110. The alternative doubled sided adhesive tape 110 is stuck to the rear surface of the back plate. The double sided adhesive tape 110 covers substantially all of the rear side of the back plate 106, but may be notched 112 adjacent the screw holes for access to the screws. The double-sided adhesive tape 110 may also include a tab 114 for removing the double-sided adhesive tape 110.

While there have been shown and described what are at present considered to be the preferred embodiments of the invention, it will be apparent to those skilled in the art that various changes and modifications can be made herein without departing from the scope of the invention defined by the appended claims.

What is claimed is:

1. A portable lamp assembly comprising:

a case including a base, the case enclosing a power source; at least one light source; and a electric switch, the light source being mechanically supported by the case to face axially toward a field to be illuminated, the switch being supported on the base, and oriented to be operated by forced contact at a switch contact between an on position and an off position by motion in the opposed axial direction; the power source, at least one light source and switch being electrically coupled together as a switched circuit; and a reflector having a first contact point anchored to the case and a second contact point abutting the switch contact, the reflector being resiliently deformable intermediate the first contact point and the second contact point, the reflector further including a formed passage sized and positioned to admit the light source there in.

2. The lamp assembly in claim 1, further including a light transmissive lens attached to the reflector to jointly define a cavity substantially enclosing at least the light emitting portion of the light source.

3. The lamp assembly in claim 1, wherein the light source comprises a plurality of LEDs arrayed around the switch.

4. The lamp assembly in claim 1, wherein the reflector includes an optical surface formed on the reflector adjacent the formed passage and facing the light source so as to receive light emitted from the light source.

5. The lamp assembly in claim 1, wherein the reflector includes at least one cutout region.

6. A portable lamp assembly comprising:

a cylindrical case having a base, the case defining an enclosed volume and an opening through the case to the enclosed volume, the case enclosing a battery power source; a plurality of LED light sources; and an electric switch; the LED light sources being mechanically supported by the case to face axially through the opening toward a field to be illuminated; the switch being supported on the base, and oriented to be operated between an on position and an off position by forced contact at a switch contact by motion in the opposed axial direction; the switch contact being located centrally in the opening; the LEDs being symmetrically arrayed around the switch contact; the battery power source, the LED light sources and the switch being electrically coupled together as a switched circuit;

a reflector formed from a resilient sheet material, sized and shaped to span the circular opening, having a plurality of coupling points formed on the periphery of the reflector and coupled to the case at said coupling points, and a reflector contact centrally positioned to abut the switch contact; the reflector including for each respective LED a corresponding through passage to admit passage of the respective LED in said respective through passage and formed adjacent said respective through passage a respective optically reflective surface positioned to receive light emitted from the respective LED light source and reflect such light to a field to be illuminated; and further including a plurality of cutouts positioned radially intermediate the coupling points and the reflector contact whereby the reflector is axially and resiliently deformable intermediate the coupling points and the switch contact; the reflector further including a lens coupling; and a light transmissive lens coupled to the reflector, the lens spanning at least the LED lights sources and the respective reflective surfaces.

7. A portable lamp assembly comprising:

a case including a base, the case enclosing a power source; at least one light source; and an electric switch, the light source being mechanically supported by the case to face axially toward a field to be illuminated; the power source, at least one light source and switch being electrically coupled together as a switched circuit;

a reflector having a first contact point anchored to the case, the reflector further including a formed passage sized and positioned to admit the light source there in; and the case having a backside providing a mounting face having a plurality of raised mounds extending from the surrounding said backside.

8. A portable lamp assembly comprising:

a case including a base, the case enclosing a power source; at least one light source; and an electric switch, the light source being mechanically supported by the case to face axially toward a field to be illuminated; the power source, at least one light source and switch being electrically coupled together as a switched circuit;

a reflector having a first contact point anchored to the case, the reflector further including a formed passage sized and positioned to admit the light source there in;

the case having a backside providing a mounting face having a plurality of raised mounds extending from the surrounding said backside; and said mounting face further supporting a doubled sided adhesive tape enabling attachment to a surface.

9. A portable lamp assembly comprising:

a case including a base, the case enclosing a power source; at least one light source; and an electric switch, the light source being mechanically supported by the case to face axially toward a field to be illuminated, the switch being supported on the base, and oriented to be operated by forced contact at a switch contact between an on position and an off position by motion in the opposed axial direction; the power source, at least one light source and switch being electrically coupled together as a switched circuit; and a reflector having a first contact point anchored to the case and a second contact point abutting the switch contact, the reflector being resiliently deformable intermediate the first contact point and the second contact point, the reflector further including a formed passage sized and positioned to admit the light source therein, wherein the light source comprises a plurality of LEDs arrayed around the switch.

10. A portable lamp assembly comprising:

a case;

a power source, a light source, and an electric switch enclosed within the case, wherein the power source, the light source and the electric switch are electrically coupled together as a switched circuit;

a reflector adjacent to said electric switch formed of a resilient material having at least one opening formed therein to receive the light source; and a light transmissive lens coupled to the reflector, the lens adapted to receive a force thereon which causes the reflector to move and thereby actuate the switch.

11. The lamp assembly in claim 10, wherein the light source comprises a plurality of LEDs arrayed around the switch.

* * * * *